United States Patent [19]

O'Neil

[11] 4,433,536

[45] Feb. 28, 1984

[54] SPIRAL WRAPPED SYNTHETIC TWINE AND METHOD OF MANUFACTURING SAME

[75] Inventor: John B. O'Neil, Summerville, S.C.

[73] Assignee: Exxon Research & Engineering Co., Florham Park, N.J.

[21] Appl. No.: 304,718

[22] Filed: Sep. 23, 1981

[51] Int. Cl.[3] ..... D02G 3/06; D02G 3/36; D02G 3/40; D02G 3/44

[52] U.S. Cl. ..... 57/233; 57/6; 57/7; 57/32; 57/234; 57/235; 57/907

[58] Field of Search ..... 57/210.6, 216.7, 220, 57/222, 232–235, 907, 31, 32

[56] References Cited

U.S. PATENT DOCUMENTS

| | | | |
|---|---|---|---|
| 3,164,947 | 1/1965 | Gaston | 57/907 X |
| 3,199,284 | 8/1965 | Scragg | 57/31 |
| 3,214,899 | 11/1965 | Wininger, Jr. et al. | 57/907 X |
| 3,380,243 | 4/1968 | Stanton | 57/235 X |
| 3,382,663 | 5/1968 | Frielingsdorf | 57/907 X |
| 3,405,516 | 10/1968 | Laureti | 57/235 X |
| 3,415,919 | 12/1968 | Kippan | 264/167 |
| 3,446,002 | 5/1969 | Kippan | 57/234 |
| 3,474,611 | 10/1969 | Suzuki et al. | 57/31 |
| 3,500,626 | 3/1970 | Sandiford | 57/907 X |
| 3,536,238 | 10/1970 | Iwama et al. | 57/907 X |
| 3,577,724 | 5/1971 | Greene | 57/907 X |
| 4,228,641 | 10/1980 | O'Neil | 57/234 |

*Primary Examiner*—John Petrakes

*Attorney, Agent, or Firm*—R. A. Dexter; R. L. Graham

[57] ABSTRACT

An improved synthetic twine and method of manufacturing same are disclosed. The synthetic twine comprises at least one longitudinally extending oriented synthetic ribbon which has been fibrillated to provide a net-like structure having fine fibril stems connected by finer fibril branches, and a synthetic binder in thin band form made of a material compatible with the synthetic ribbon. The synthetic binder is spirally wrapped around and fused to the synthetic ribbon. The method of making a twine comprises the steps of providing at least one longitudinally extending ribbon, orienting the synthetic ribbon and fibrillating the synthetic ribbon to provide a net-like structure having fine fibril stems connected by finer fibril branches. Thereafter, a synthetic binder in thin bank form is spirally wrapped and fused around the synthetic ribbon which has been oriented and fibrillated. Such a twine is more economical to produce, yet exhibits comparable characteristics to conventional synthetic twines, particularly in terms of knotting strength.

33 Claims, 3 Drawing Figures

SPIRAL WRAPPED SYNTHETIC TWINE AND METHOD OF MANUFACTURING SAME

FIELD OF THE INVENTION

The present invention relates to synthetic twine, and more particularly to a synthetic twine and method of manufacture which provide significant cost savings over conventional synthetic twines and methods of manufacturing same, while at the same time providing comparable characteristics for the resulting product, especially in terms of knotting strength.

BACKGROUND OF THE INVENTION

It is well known that twines and cords for a variety of purposes may be produced almost entirely from natural fibers. While such natural fiber twines and cords have filled their intended purpose, more recently they are being replaced by superior synthetic products; for example, as evidenced by the rapid increase in usage of polypropylene yarns for rope construction. Such synthetic twines have also found particular application as agricultural twines, for example binder and baler twines, and as commerical twines such as tying twines and cable fillers. In many of these applications, particularly for agricultural and tying twine uses, the synthetic twines are used in connection with automatic tying equipment.

The knot strength of twine, either natural or synthetic, is usually significantly less than the tensile strength of the twine, for example generally on the order of 50% to 60% of the tensile strength. Accordingly, in those applications involving the tying of knots, the knot strength is generally considered as the limiting factor in choosing a particular strength twine. Consequently, in order to achieve a sufficient knot strength for any desired purpose, the tensile strength of the prior art twine generally was much higher than was necessary for a particular application. In other words, since the strength of the twine generally is related to the gauge of the twine, heavy and more bulky twines have been required in order to achieve a desired knot strength.

Some of the known prior art synthetic twines have comprised a plurality of synthetic fibers such as monofilaments, flat tapes, ribbons, etc. which are twisted together, much in the manner that conventional natural fiber twines are twisted together. The twisting operation is for the purpose of containing and holding together the various synthetic fibers to provide a generally unitary structure in which the stress of one fiber is transmitted to the next in order to develop the continuity and strength of the resulting twine and cord. Examples of such prior art twines are known from U.S. Pat. Nos. 3,332,228 (twisting of strips of polypropylene film together to form a twine); 3,422,616 (false twisting of strips of oriented synthetic films to randomly fibrillate the films, and thereafter true twisting a plurality of such films together to form a twine); and 3,402,547 (twisting of films, ribbons, filaments or fibers made from steroregular polypropylene to form a twine). While such prior art twines have exhibited the required strength characteristics, they have also exhibited a tendency to unwind or unravel during use, which, as can be appreciated, is undesirable and tends to decrease the resulting strength and abrasion resistance of the twine during use. Furthermore, such twisted synthetic fiber twines are relatively expensive to manufacture on a commercial bases since it is a two step process requiring specialized equipment; for example, extrusion/orientation of tape yarns followed by a separate and discrete twisting operation.

Another class of prior art synthetic twines have involved the use of a plurality of parallel synthetic monofilaments, generally of a round cross sectional configuration, which are grouped together and then wrapped in a casing or other binding material to maintain a unitary structure so that the stresses on the individual fibers are transmitted to other fibers to develop the required continuity and strength for the resulting twine. Various patents relating to such techniques include, for example, U.S. Pat. Nos. 3,415,919, 3,446,002; and 4,228,641 which disclose the use of a synthetic binder material in thin band form which is spirally wrapped and fused about a plurality of synthetic monofilaments. Such prior art twines are advantageous in the sense that they are continuously produced and eliminate the separate and costly twisting operations. In other words, the individual core monofilaments need not be twisted, such as for example shown in U.S. Pat. Nos. 3,446,002 and 3,415,919, or maybe false twisted (i.e., in which a twist is applied intermediate the ends of the monofilaments and which, if released, would return to a zero twist), such as for example shown in U.S. Pat. No. 4,228,641. With the prior art false twisted twines, the casing or binder material serves to retain a portion of the false twist. While such encased synthetic twines exhibit sufficient strength characteristics, difficulties have been encountered in connection with slippage of knots when such twines are tied. In other words, such monofilament encased twines do not exhibit good cinching properties. Furthermore, the cost of producing such monofilament twines is relatively high since monofilament producing equipment is generally more expensive to buy and operate than equipment for producing sheets of synthetic material which can be slit and oriented to form flat tape yarns.

Therefore, while many of the prior art synthetic twines have proven useful for their intended purposes, i.e., providing desired knotting characteristics, the search has continued for improved twines and methods of manufacturing same which result in a reduction of the cost of the twine and cost involved in the production of such twines. This is particularly true with respect to twines which are used in connection with mechanical and automatic tying equipment, e.g., agricultural twines and commercial twines, wherein the knot strength of the twine is considered to be one of the limiting characteristics in regard to the usefulness of the twine. Accordingly, it is an object of the present invention to provide a synthetic twine having knotting characteristics comparable to those of the prior art but which is more economical to produce, thereby resulting in a less expensive twine.

SUMMARY OF THE INVENTION

In accordance with the present invention, there is provided a synthetic twine comprised of at least one longitudinally extending oriented synthetic ribbon which has been fibrillated to provide a net-like structure having fine fibril stems connected by finer fibril branches, and a synthetic binder material in thin band form which is spirally wound around and adhered to the at least one synthetic ribbon.

Such a twine, because of the ordered net-like structure for the synthetic ribbon which results from fibrillation, provides a much softer product which is easier to knot and cinch than conventional prior art synthetic twines made of monofilaments. At the same time, the twine, which is more economical to produce because it does not employ monofilaments, has unexpectedly been found to exhibit a higher knot strength in comparison to its resulting tensile strength. That is, while the operation of fibrillating the synthetic ribbon tends to result in a lower tensile strength for the resulting product, the overall knot strength is comparable to that of conventional prior art twines, such as for example a twine comprised of a plurality of monofilaments having a synthetic binder in thin band form spirally wound around and fused to the monofilaments.

The method in accordance with the present invention comprises the steps of providing at least one longitudinally extending synthetic ribbon, orienting the ribbon along its longitudinal length, and fibrillating the ribbon to provide a net-like structure of fine fibril stems connected by even finer fibril branches. Thereafter, a synthetic binder material in thin band form is spirally wrapped and adhered about the oriented and fibrillated synthetic ribbon to produce the resulting twine. Thus, it will be appreciated that in accordance with the method of the present invention, no expensive twisting or false twisting equipment is required to produce the twine; rather a single synthetic ribbon may be utilized which is oriented and fibrillated in accordance with conventional techniques and is then spirally wrapped with a suitable synthetic binder material which is of a material compatible with the synthetic ribbon. Thus, significant cost reductions and savings can be obtained in accordance with this method, yet the overall knot strength of the resulting twine is comparable to that of conventional synthetic twines produced in accordance with prior art methods.

In accordance with a preferred embodiment of the present invention, the synthetic ribbon is fibrillated so that the finer fibril branches have a denier between 80 and 2,000, and more preferably between 100 and 500, and in which the average denier of the fine fibril branches is between 200 and 1,000, and more preferably between 250 and 350. The denier of the stems is preferably from about 1 to 10 times the denier of the finer branches, and more preferably from about 2 to about 5 times the denier of the branches. Also, in accordance with the preferred embodiment, only a single synthetic ribbon having a zero twist, i.e., essentially no twist along its length, may be used to produce the twine of the present invention.

Still further in accordance with the preferred embodiment, the synthetic spiral band preferably contains between 8 and 30 spirals per linear foot of synthetic ribbon, and more preferably between 10 and 16 spirals per linear foot.

These and further features and characteristics of the present invention will be apparent from the following detailed description in which reference is made to the enclosed drawings which illustrate the preferred embodiment of the present invention.

DETAILED DESCRIPTION OF THE PREFERRED EMBODIMENT

Figure 1:
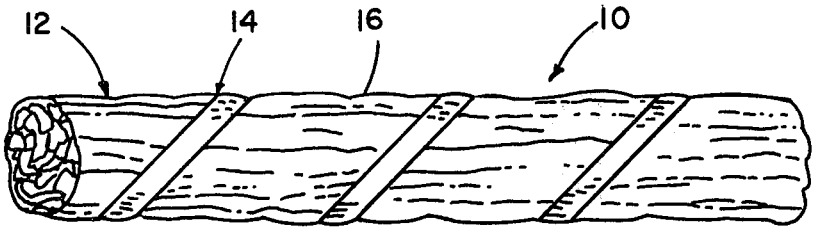
FIG. 1 is an enlarged view of a segment of the twine in accordance with the present invention.

Referring now to the drawings wherein like reference characters represent like elements, FIG. 1 illustrates an enlarged segment of twine 10 made in accordance with the present invention. The twine 10 generally comprises a core structure or section 12 having a synthetic binder in thin band form 14 spirally wound around and adhered to the core section 12. In accordance with the present invention, the core section 12 comprises at least one longitudinally extending oriented synthetic ribbon 16 which has been fibrillated to provide a substantially ordered fibril structure, such as illustrated on a greatly enlarged scale in FIG. 2.

As used herein, ordered fibrillated ribbons refer to products which have been fibrillated to produce a substantially ordered net-like structure having many fine fibril backbones or stems 18 connected by even finer fibril branches 20. Such structures may be formed in any well known manner, for example, by utilizing a rotating pin roller consisting of spaced rows of pins mounted on the periphery of the roller and over which a ribbon is drawn at a speed somewhat less than the peripheral speed of the roller so that perforations or slits 22 disposed in spaced, staggered parallel relationship are formed in the ribbon 16, these slits 22 being so disposed that expansion of the strip or ribbon 16 reveals the net-like structure. In a variation of this means, the roller may consist of peripherally mounted rows of hack-saw or band saw blades which rotate in relation to the moving ribbon to form staggered slits or perforations to thereby produce the fibrils along the length of the ribbon. Also, other cutting means may be utilized for providing an ordered network of fibrils.

Ordered fibrillated ribbons 16 are to be contrasted with random fibrillated ribbons which provide a random fibrous network having many different width and length fibers which are generally randomly connected at only one end to the remaining structure. More particularly, it is well known that highly oriented polymeric films generally contain a pattern of incipient fracture lines along which the film can be induced to split spontaneously, such as for example by twisting, rubbing and stretching techniques. When expanded, the split film so produced reveals a fibrous random network of fibrils which have no characteristic branch width or length frequency distribution since the film inherently splits specific amounts in particular locations. This splitting depends upon the molecular arrangement, the intermolecular forces, the degree of orientation of the material, and the method used to induce the splitting. Consequently, no ordered or uniform network is produced having fine fibril stems connected by finer fibril branches; rather random fibrillated ribbons have fibrils of a non uniform size and distribution.

Figure 3:
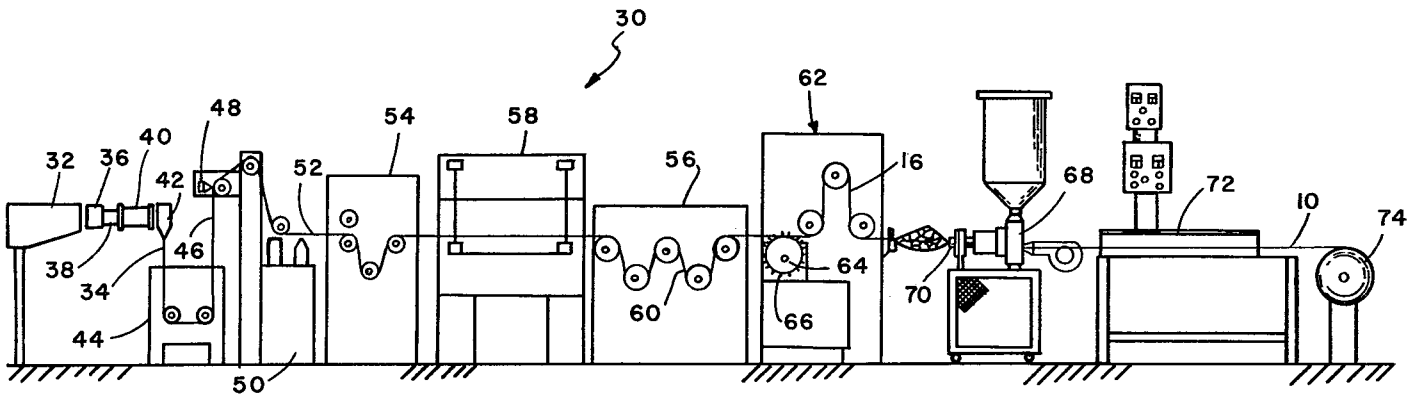
FIG. 3 is a schematic illustration of an apparatus which may be used to produce the twine shown in FIG. 1 in accordance with the present invention.

Referring now to FIG. 3 which illustrates schematically an apparatus 30 for producing the twine 10 in accordance with the present invention, there is shown a conventional extruding apparatus 32 for producing a sheet 34 of polymeric film which may then be used to produce longitudinally extending, oriented synthetic ribbons. The extruding apparatus 32 includes an appropriate feed hopper (not shown) which receives synthetic material, such as for example thermoplastic resin and pigment, as well as chopped edge trim, which is melted and mixed therein. A screen element 36 may be provided in the extruding apparatus 32 for removing contaminates. The molten polymer is then presented at a low pressure to the inlet of a gear pump 38 where it passes to a static mixer 40 which serves to homogenize the polymer pigment and provide a uniform melt temperature for the molten polymer. The molten polymer is then fed to an extrusion die 42 where it is then extruded into a sheet 34. The extruded sheet 34 then passes to a quench tank 44 for quenching and setting the polymeric material to thereby form an unoriented sheet 46 of polymeric film.

The unoriented sheet 46 is then taken away by a driven nip roll 48 and is passed through a conventional slitter mechanism 50 which serves to slit the sheet 46 to various widths to provide a plurality of longitudinally extending ribbons or tapes 52. At the slitter mechanism 50, the sheet 46 is trimmed to eliminate edges which may tend to break or fracture during the subsequent orientation process, the trimmed edges being continuously fed back to the extruding apparatus 32. The series of unoriented ribbons or tapes 52 are then oriented in a conventional manner, such as by heating the ribbons 52 and stretching or drawing the heated ribbons 52. This is accomplished for example by feeding the ribbons 52 between first and second godets 54, 56 while passing the ribbons 52 through an oven 58. For conventional polymeric materials, the oven temperature is approximately 260 to 380 degrees F., depending upon the orientation speed. The second godet 56 is operated preferably at from five to fifteen times the rate of the first godet 54, and more preferably from seven to twelve times the rate of the first godet 54, so that the ribbons 52 are stretched or elongated to thereby produce oriented ribbons 60 which are oriented primarily along their longitudinal length.

The apparatus 30 and method described hereinabove for producing the longitudinally extending, oriented ribbons 52 generally corresponds to conventional apparatus and methods for producing oriented ribbons or tapes, and are well known in the art.

Immediately downstream of the second godet 56, and after the orientation process, the warm oriented ribbons or tapes 60 are fibrillated utilizing an appropriate fibrillating mechanism 62. In the preferred embodiment, the fibrillating mechanism 62 comprises a rotating fibrillator roll 64 containing rows of blades or pins 66 which are arranged in rows parallel to the axis of the roll 64 but oriented at an angle to the radius. The cutting blades or pins 66 comprise points on the surface of the fibrillator roll 64 which are uniformly spaced in both the x and y directions. Generally, the fibrillator roll 64 is rotated in the tape direction of movement, but at a speed which is greater than the speed of movement of the ribbons 60.

Figure 2:
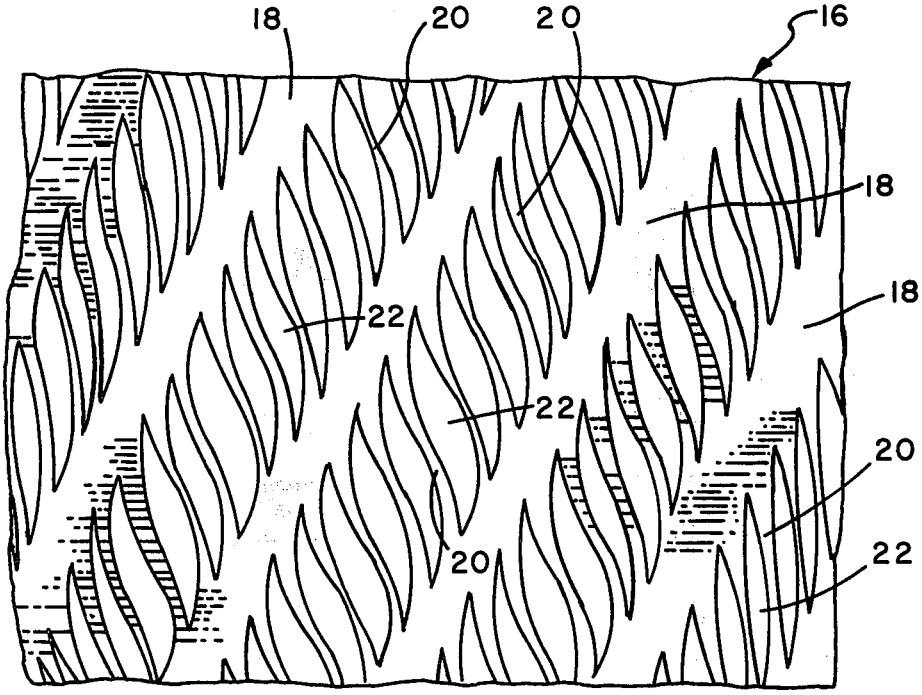
FIG. 2 is an enlarged illustration of a segment of synthetic ribbon which has been fibrillated to provide a substantially ordered net-like structure having fine fibril stems connected by finer fibril branches, such a synthetic ribbon being employed in producing the twine in accordance with the present invention.

During the fibrillating operation, the tapes or ribbons 60 are split where they come in contact with the cutting blades or pins 66, and in a direction parallel to the direction of motion of the tapes or ribbons 60, thereby producing fibril stems 18 and branches 20 in the resulting ribbons 16 which are of a constant width and length for the particular patterned fibrillator roll 64. That is, in each fibrillated tape or ribbon 16, there exists at least one definite stem section 18 (which generally comprises an upsplit portion of the ribbon 16 of a certain width) which is defined by the end points of the splits 22 made by one row of cutting blades or pins 66 and that joining the beginning points of splits 22 made by an adjacent row of cutting blades or pins 66, as best seen in FIG. 2. This fibrillating operation produces what may be termed an ordered net-like structure, which is reproducible at all times, comprised of a plurality of fine fibril stems 18 connected by even finer fibril branches 20.

After the fibrillating operation, the ordered fibrillated ribbons 16 are directed to a spiral wrap rotating die apparatus 68 for spirally wrapping a thin band 14 of synthetic binder material about each of the fibrillated ribbons 16. The spiral band 14 is formed in such a manner as to leave gaps between the windings such that some of the synthetic ribbon is exposed. In this regard, the spiral wrap rotating die apparatus 68 may be similar to that illustrated and described in U.S. Pat. No. 3,415,919 to Kippan which serves to direct a stream of compatible molten synthetic material onto a generally cylindrical core component 12. In accordance with the present invention, the core component 12 comprises at least one synthetic ribbon 16 which has been fibrillated. In the preferred embodiment, the core component 12 consists of only a single synthetic fibrillated ribbon 16, although, if desired, a plurality of such ribbons 16 could be brought together and spirally wrapped as a unit.

The fibrillated ribbon or ribbons 16 are compressed and compacted into a generally cylindrical shape in passing through the inlet cone 70 of the spiral wrap rotating die apparatus 68. A stream of molten synthetic material is then spirally wrapped around the compressed and compacted ribbon or ribbons 16 as they continue to pass through the spiral wrap die apparatus 68. After a spiral band 14 of comparable synthetic mterial has been applied to the core section 12, the ribbon or ribbons 16, with the spiral binder thereon, are passed through a water quench apparatus 72 for fusing the spiral wrapped thin band 14 onto the fibrillated synthetic ribbon or ribbons 16. In this regard, the synthetic material for the spiral wrap 14 is preferably made of a material compatible to that of the synthetic ribbon 16 so that the band 14 will not only be spirally wrapped about the synthetic ribbon 16 but will also be adhered thereto. By compatible, it is meant that the thin band 14 of synthetic material is made of a material which will adhere to the synthetic ribbon.

The resulting twine 10 then passes through a third godet 74 operating at nearly the same speed as the second godet 56 to maintain tension on the ribbon 16 during the spiral wrapping operation. From the third godet 74, the finalized spirally wrapped twine 10 then passes through a set of rolls 76 which deliver the twine 10 to a suitable drum take-up 78 or other take-up device before final packaging.

Here it should be noted that in accordance with the preferred embodiment of the present invention, a plurality of twines 10 are simultaneously produced with the apparatus 30 shown in FIG. 3. More particularly, a single sheet 46 of unoriented polymeric film is produced which is then split of slit into a plurality of individual tapes or ribbons 52. The plurality of ribbons 52 are simultaneously oriented, and then simultaneously fibrillated. Each of the oriented and fibrillated ribbons 16 is then fed to a respective spiral wrap rotating die 68 where a synthetic binder in thin band form 14 is spirally wrapped around and fused to each fibrillated ribbon 16. In this regard, it will be appreciated that a spiral wrap rotating die apparatus 68 can be utilized which has a plurality of inlet cones and rotating dies, one for each ribbon or set of ribbons 16 to be spirally wrapped.

The resulting twine 10 is much softer than conventional monofilament twines having a core comprised of monofilaments about which a spiral band is wrapped and fused. That is, the resulting twine 10 of the present invention is not as stiff or inflexible as conventional monofilament spirally banded twine. This is advantageous as the softer, fibrillated ribbon, spirally banded twine 10 of the present invention is much easier to knot and cinch, thereby insuring that knots will not slip or be missed, particularly when utilized in automatic tying machines and the like. At the same time the twine 10 has a knot strength which is comparable to that of conventional spirally wound monofilament twines.

Here it should be noted that one advantage of utilizing ordered fibrillated ribbons 16 is that such ordered fibrillated ribbons 16 generally exhibit a consistent strength along their length because of the uniform and ordered nature of the produced fibrils 18, 20. This is particularly important in order to produce a twine having a generally consistent strength along its length. With a random fibrillated ribbon, since the ribbon splits different amounts at different locations, there would be a less uniform fibrillar structure along the length of the ribbon and thus the strength of the resulting twine would not be uniform along its length. Consequently, as the usefulness of any twine in terms of strength is necessarily dependent on the lowest strength exhibited along the length of the twine, with a randomly fibrillated ribbon used as the core section, such twine would generally exhibit less uniform strength characteristics in comparison to the twine 10 of the present invention.

A further advantage of using a fibrillated ribbon 16 for the core section or component 12 of the twine 10 is that such ordered fibrillated ribbons 16 are generally easily reproducible. That is, ordered fibrillation is preferred since the degree of fibrillation imparted to the ribbons 16 can be consistently repeated on a commercial basis so that fibrillated ribbons 16 produced at different times will exhibit the same characteristics. As the characteristics of the resulting twine 10, particularly in terms of the knot strength, are dependent on the degree of fibrillation which is imparted to the ribbon 16 during the formation process, it is thus possible to repeatedly produce twine 10 of desired characteristics on a consistent basis.

Still further in this regard, while the overall characteristics of the resulting twine 10 are dependent on the degree of fibrillation imparted to the ribbon 16 forming the core section 12 of the twine 12, the fact that an ordered network is provided for the ribbon in accordance with the present invention, as contrasted to a randomly fibrillated structure, is significant from the standpoint of producing a generally "softer" twine 10 which has better knotting capabilities, in terms of cinching or holding a knot after it is formed. Also, since extraneous unconnected fibrils are minimized, problems of the twine 10 looping, catching, or snagging in automatic tying equipment is also minimized.

In the preferred embodiment, the degree of fibrillation imparted to the synthetic ribbon 16 is such that each of the finer fibril branches 20 has a denier between 80 and 2,000, and such that the average denier of the finer fibril branches 20 is between 200 and 1,000. More preferably, the denier of each of the fine fibril branches 20 is between 100 and 500, and the average denier is between 250 and 350. In this regard, it is to be recalled that the fibril branches 20 formed in the ordered net-like structure are generally of a smaller size, and therefore of a lower denier, than the fibril stems 18. Preferably the denier of the fine stems 18 is from about one to about ten times the denier of the finer branches 20, and more preferably from about two to about five times the denier of the branches 20. The overall denier of the resulting twine 10, as can be appreciated, will be dependent upon the width and thickness of the fibrillated ribbon 16, and typically may range from approximately 1,000 denier to 70,000 denier or higher.

The spiral band 14 should be quite thin so as to not interfere with the flexibility of the twine 10. In the preferred embodiment, the spiral band 14 has a weight of from about 10% to about 25% of the total weight of the twine 10, and more preferably a weight from about 12% to about 18% of the total weight of the twine 10. The spiral band 14 may be of any desired cross section, although it is preferable to use bands of rectangular or oval cross section. The number of spirals contained in the spiral band 14 of synthetic binder material should be chosen so as to be sufficient to hold or maintain the shape and integrity of the fibrillated ribbon 16, i.e., so that it does not unravel or distort during use, yet should not be so great as to impart too great a stiffness to the resulting twine 10 which might otherwise inhibit the capability of tying and holding knots. In this regard, in the preferred embodiment, the synthetic spiral band 14 spirally wound about and fused to the fibrillated synthetic ribbon 16 contains between 8 and 30 spirals per linear foot of the synthetic ribbon 16 and, more preferably contains from 10 to 16 spirals per linear foot.

Still further, in this regard, because of the high degree of fibrillation imparted to the ribbon 16, the resulting fibrillated ribbon 16 is very soft and has a greater total specific surface area than a randomly fibrillated ribbon. Consequently, when the spiral band 14 is spirally wound about and bound to the fibrillated ribbon 16, there is more surface area for binding the band 14, thereby improving the integrity of the overall twine 10.

It is also important to note that in accordance with the preferred embodiment, it is not necessary to twist, either true or false, the fibrillated ribbon 16 along its length, as required in connection with conventional prior art twine made from flat tapes or ribbons. This is generally referred to as a zero-twist product, and is particularly advantageous as the equipment and operations involved in producing twists in filaments or windings is most expensive, which in turn serves to increase the cost of producing such prior art twine. However, if desired, either a true twist or a false twist could be imparted to the ribbon or ribbons 16 prior to spirally wrapping the ribbon or ribbons 16 with a band 14 of synthetic binder.

The synthetic materials employed in accordance with the present invention for the ribbons 16 and spiral band 14 are preferably prepared from synthetic thermoplastic resins such as polyolefins, polyamides, polyesters, polycarbonates, polyvinyls, and mixtures thereof. In the preferred embodiment, polypropylene materials are utilized.

In accordance with one example of the preferred embodiment, polypropylene resin of 3–4 melt flow rating is extruded by the extrusion apparatus 32 to produce an unoriented sheet 46 of approximately 10 mils in thickness. This sheet 46 is then split into approximately six inch widths, and then oriented or stretched at a ratio 9 to 1. That is, the first godet 54 may be operated to move the tapes or ribbons 52 at 40 feet per minute, whereas the second godet 56 is operated to move the tapes or ribbons 52 at 360 feet per minute. The oven temperature between the first and second godets 54, 56, for example, may be 320° F. After the orienting process, each of the ribbons or tapes 52 is approximately 3 mils in thickness and 2½ inches wide. The fibrillating roll 64 preferably has 10 teeth per inch, and is rotated to approximately 900 feet per minute, to produce an ordered fibrillated ribbon 16 comprised of fine fibril stems 18 connected by even finer fibril branches 20. The fibril branches 20 have a denier between 100 and 500, with an average denier between 250 and 350, and the denier of the stems 18 is from about two to five times the denier of the branches 20. Each of the fibrillated ribbons 16 is then fed through the spiral wrap rotating die apparatus 68 which spirally wraps a thin band 14 of molten synthetic polypropylene onto each fibrillated ribbon 16 at the rate of 14 spiral bands per linear foot of ribbon 16. The thin band 14 is then fused to the synthetic ribbon 16 by passing same through the quench tank 72. The weight of the polypropylene for the thin band 14 is about 14% of the finished weight of the twine 10. The finished twine 10 is then delivered to the drum take-up 78.

The finished twine 10 has a bale weight of approximately 21.1 pounds per 10,000 feet. The bale weight is a linear density measurement, commonly used in the industry, and is used herein to indicate the amount of synthetic resin required to produce the twine 10. The bale weight thus represents a useful characteristic for comparison purposes. The tensile strength of the resulting twine 10 is approximately 130 pounds, and the knot strength is approximately 118 pounds. In this regard, the tensile strength is the force required to break an unknotted twine, whereas the knot strength is the force required to break a twine which has been knotted. Here, it is to be noted that generally, the knot strength of a twine is approximately 50% to 60% of the tensile strength of the twine. However, the knot strength of the twine 10 in accordance with the present invention is on the order of 80% to 95%, or higher, of the tensile strength. This, for example, may be expressed as the knot translation of the twine 10, which is the ratio of the knot strength of the tensile strength.

The following table shows a comparison between these various characteristics for a twine 10 produced in accordance with the present invention and a monofilament, spirally wrapped twine of the prior art in which the monofilaments have been false twisted, such as the example shown in the U.S. Pat. No. 4,228,641.

| | Spiral Wrapped, Fibrillated Ribbon Twine of Present Invention | Spiral Wrapped, False Twisted Monofilament Twine |
|---|---|---|
| Bale Weight (lbs./10K ft.) | 21.1 | 23.0 |
| Tensile Strength (lbs.) | 130 | 295 |
| Knot Strength (lbs.) | 118* | 130* |
| Knot Efficiency (KS/BW) | 5.60 | 5.65 |
| Knot Translation (KS/TS) | .91 | .44 |

*Knot strength values were determined using common baler type knot (Deering knot).

Thus, it can be seen that in accordance with the present invention a twine 10 having a lower bale weight has a comparable knot strength and knot efficiency, and a higher knot translation in comparison to a spirally wrapped, false twisted monofilament twine. In other words, by utilizing an ordered fibrillated ribbon 16 to produce a spiral wrapped twine 10, it is possible to maintain a comparable knot strength at a lower bale weight, which thus results in a lower cost product, not only in terms of the amount of material which was required, but also in terms of the equipment and operational requirements. Here it should also be noted that because of the highly uniform characteristic of the synthetic ribbon 16 utilized in producing the twine 10, the variation in knot strength for the twine 10 is expected to be significantly lower than the variation in knot strength for a spiral wrapped, false twisted monofilament twine of the prior art. Further, in this regard, as is known in the industry, it is generally more expensive to produce monofilaments than it is to produce a flat film from the same amount of materials, both in the cost of the initial equipment as well as in the cost of operating such equipment (as monofilament producing equipment generally tends to require cleaning more often).

A further advantage in accordance with the present invention is the fact that generally spurious or extraneous fibrils are not produced which might otherwise "catch" in the mechanical and automatic tying equipment presently utilized in the agricultural and tying twine end uses, and which might otherwise serve to weaken or destroy the twine. As can be appreciated, if fibrils or portions of a twine loop, catch or snag in the knotting equipment, there is the possibility that the twine will be weakened or even destroyed.

Therefore, in accordance with the present invention, it is seen that there is provided a twine 10 having comparable knotting characteristics to conventional twine but which is significantly more economical to produce. The twine 10 in accordance with the present invention comprises at least one longitudinally extending oriented synthetic ribbon 16 which has been fibrillated to provide a net-like structure having fine fibril stems 18 connected by finer fibril branches 20, and in which a synthetic binder in thin band form 14 is spirally wound around and bonded to the synthetic ribbon 16. In the preferred embodiment, the fine fibril branches 20 of the oriented fibrillated synthetic ribbon 16 have a denier between 80 and 2,000, and an average denier between 200 and 1,000. The stems 18 have a denier which is between one and ten times the denier of the branches 20. Also, the number of spirals of the spiral band 14 wound around and adhered to the synthetic ribbon 16 is preferably between 8 and 30 spirals per linear foot of ribbon.

In accordance with the method of the present invention, at least one longitudinally extending synthetic ribbon 56 is provided which is then oriented and fibrillated to provide a net-like structure having fine fibril stems 18 connected by finer fibril branches 20. Thereafter, a synthetic binder in thin band form 14 is spirally wrapped around and bonded to the oriented and fibrillated synthetic ribbon 16. The synthetic binder 14 preferably is made of a material compatible with the synthetic ribbon 16. In the preferred embodiment, the step of fibrillating is performed after the step of orienting the synthetic ribbon 52.

While the preferred embodiment of the present invention has been shown and described, it will be understood that such is merely illustrative and that changes may be made without departing from the scope of the invention as claimed.

What is claimed is:

1. A tying twine comprising:

at least one longitudinally extending oriented synthetic ribbon which has zero twist and has been slit fibrillated to provide a substantially ordered net-like structure having fine fibril stems connected by finer fibril branches; and a synthetic binder in thin band form spirally wound around and adhered to said at least one synthetic ribbon to form longitudinally spaced spirals.

2. The twine of claim 1 wherein the denier of said fibril branches of said at least one longitudinally extending oriented synthetic ribbon is between 80 and 2000, and the average denier of such fibril branches is between 200 and 1000.

3. The twine of claim 2 wherein the denier of said stems is between about one and about ten times the denier of said fibril branches.

4. The twine of claim 2 wherein the denier of said fibril branches is between 100 and 500, and wherein the average denier of said fibril branches is between 250 and 350.

5. The twine of claim 4 wherein the denier of said stems is from about two to about five times the denier of said fibril branches.

6. The twine of claim 1 wherein said synthetic binder in thin band form is made of a material compatible with said at least one synthetic ribbon, and wherein said synthetic binder is fused to said at least one synthetic ribbon.

7. The twine of claim 6 wherein said synthetic binder wound about said at least one synthetic ribbon contains between 8 to 30 spirals per linear foot of synthetic ribbon.

8. The twine of claim 7 wherein the weight of said synthetic binder is from about 10% to about 25% of the total weight of said twine.

9. The twine of claim 7 wherein said synthetic binder contains between 10 to 16 spirals per linear foot of synthetic ribbon.

10. The twine of claim 9 wherein the weight of said synthetic binder is from about 12% to about 18% of the total weight of said twine.

11. The twine of claim 1 wherein said at least one synthetic ribbon and said synthetic binder are thermoplastic resins selected from the group consisting of polyolefins, polyamides, polyesters, polycarbonates, polyvinyls, and mixtures thereof.

12. The twine of claim 11 wherein said at least one synthetic ribbon and said synthetic binder are made of a polypropylene material.

13. A method of making a tying twine comprising of steps:

providing at least one longitudinally extending synthetic ribbon;

orienting said at least one synthetic ribbon along the longitudinal length thereof;

slit fibrillating said at least one synthetic ribbon to provide a substantially ordered net-like structure having fine fibril stems connected by finer fibril branches; and thereafter spirally wrapping and adhering a synthetic binder in thin band form around said at least one synthetic ribbon which has zero twist and has been oriented and fibrillated to form a twine bound by longitudinally spaced spirals.

14. The method of claim 13 wherein said step of orienting comprises heating said at least one synthetic ribbon and elongating said at least one synthetic ribbon between 5 and 15 times its original length.

15. The method of claim 14 wherein said step of elongating comprises elongating said at least one synthetic ribbon between 7 and 12 times its original length.

16. The method of claim 14 wherein said step of elongating comprises feeding said at least one synthetic ribbon between first and second moving means in which said second moving means is operated to move said at least one synthetic ribbon at a rate which is between 5 times and 15 times the rate at which said first means moves said at least one synthetic ribbon.

17. The method of claim 14 wherein said step of fibrillating is performed after said step of orienting.

18. The method of claim 13 wherein said step of fibrillating comprises fibrillating said at least one synthetic ribbon so that the denier of said fibril branches is between 80 and 2000 and the average denier of said fibril branches is between 200 and 1000.

19. The method of claim 18 wherein said step of fibrillating comprises fibrillating said at least one synthetic ribbon so that the denier of said stems is from about one to about ten times the denier of said fibril branches.

20. The method of claim 18 wherein said step of fibrillating comprises fibrillating said at least one synthetic ribbon so that the denier of said fibril branches is between 100 and 500, and the average denier of said fibril branches is between 250 and 350.

21. The method of claim 20 wherein said step of fibrillating comprises fibrillating said at least one synthetic ribbon so that the denier of said stems is from about two to about five times the denier of said fibril branches.

22. The method of claim 18 wherein said step of fibrillating comprises moving said at least one synthetic ribbon past a roll having a plurality of spaced cutting means thereon and rotating said roll at a rate greater than the rate of speed at which said at least one synthetic ribbon moves therepast.

23. The method of claim 22 wherein said roll has a plurality of pins thereon.

24. The method of claim 13 wherein said step of providing at least one longitudinally extending synthetic ribbon comprises slitting a sheet of synthetic material into a plurality of longitudinally extending synthetic ribbons, and wherein said steps of orienting and fibrillating are performed on each of said synthetic ribbons.

25. The method of claim 24 wherein said step of spirally wrapping and adhering a synthetic binder comprises spirally wrapping and adhering a synthetic binder in thin band form around each of said slit synthetic ribbons to form a plurality of twines.

26. The method of claim 13 wherein said step of spirally wrapping and adhering comprises spirally wrapping a synthetic binder in thin band form around said at least one synthetic ribbon, said synthetic binder being of a material which is compatible with said at least one synthetic ribbon, and fusing said synthetic binder to said at least one synthetic ribbon.

27. The method of claim 13 wherein said step of spirally wrapping and adhering a synthetic binder around said at least one synthetic ribbon is performed so as to provide between 8 and 30 spirals per foot of synthetic ribbon.

28. The method of claim 27 wherein the weight of said synthetic binder is from about 10% to about 25% of the total weight of said twine.

29. The method of claim 27 wherein said step of spirally wrapping and adhering a synthetic binder around said at least one synthetic ribbon is performed so as to provide between 10 and 16 spirals per foot of synthetic ribbon.

30. The method of claim 29 wherein the weight of said synthetic ribbon is from about 12% to about 18% of the total weight of said twine.

31. The method of claim 13 wherein said at least one synthetic ribbon and said synthetic binder are thermoplastic resins selected from the group consisting of polyolefins, polyamides, polyesters, polycarbonates, polyvinyls and mixtures thereof.

32. The method of claim 31 wherein said at least one synthetic ribbon and said synthetic binder are made of a polypropylene material.

33. The twine as defined in claim 1 wherein the twine comprises not more than one of said longitudinally oriented synthetic ribbon.

* * * * *